US010325703B2

(12) United States Patent
Sun et al.

(10) Patent No.: US 10,325,703 B2
(45) Date of Patent: Jun. 18, 2019

(54) VARISTOR COMPONENT AND METHOD FOR SECURING A VARISTOR COMPONENT

(71) Applicant: EPCOS AG, München (DE)

(72) Inventors: Shaoyu Sun, Zhuhai (CN); Xiaojia Tian, Zhuhai (CN); Rongguang Zhang, Zhuhai (CN)

(73) Assignee: EPCOS AG, Munich (DE)

( * ) Notice: Subject to any disclaimer, the term of this patent is extended or adjusted under 35 U.S.C. 154(b) by 0 days.

(21) Appl. No.: 16/070,210

(22) PCT Filed: Jan. 24, 2017

(86) PCT No.: PCT/EP2017/051393
§ 371 (c)(1),
(2) Date: Jul. 13, 2018

(87) PCT Pub. No.: WO2017/140463
PCT Pub. Date: Aug. 24, 2017

(65) Prior Publication Data

US 2019/0027282 A1 Jan. 24, 2019

(30) Foreign Application Priority Data

Feb. 19, 2016 (DE) ..... 10 2016 102 968

(51) Int. Cl.
*H01C 7/12* (2006.01)
*H01H 85/02* (2006.01)
(Continued)

(52) U.S. Cl.
CPC ..... *H01C 7/126* (2013.01); *H01H 85/0241* (2013.01); *H01H 85/048* (2013.01);
(Continued)

(58) Field of Classification Search
CPC . H01C 7/126; H01C 1/02; H01C 1/14; H01H 85/0241; H01H 85/048; H01H 85/2045
See application file for complete search history.

(56) References Cited

U.S. PATENT DOCUMENTS 6,430,019 B1 * 8/2002 Martenson ..... H01C 7/126 361/103
6,636,403 B2 10/2003 McLoughlin et al.
(Continued)

FOREIGN PATENT DOCUMENTS

CN 1723595 A 1/2006
CN 203165599 U 8/2013
(Continued)

*Primary Examiner* — Kyung S Lee
(74) *Attorney, Agent, or Firm* — Slater Matsil, LLP

(57) ABSTRACT

A varistor component and a method for securing a varistor component are disclosed. In an embodiment, a varistor includes a first external contact, a second external contact, a varistor electrically connected to the first external contact, a path between the varistor and the second external contact and an active releasing device including a shutter and a heat sensitive element, wherein the heat sensitive element releases the shutter under abnormal operation conditions and the shutter closes the path between the varistor and the second external contact.

14 Claims, 5 Drawing Sheets

(51) Int. Cl.

| | |
|---|---|
| ***H01H 85/048*** | (2006.01) |
| ***H01H 85/36*** | (2006.01) |
| ***H01H 85/20*** | (2006.01) |
| *H01C 1/02* | (2006.01) |
| *H01H 85/06* | (2006.01) |
| *H01H 85/175* | (2006.01) |
| *H01C 1/14* | (2006.01) |

(52) U.S. Cl.
CPC ..... *H01H 85/2045* (2013.01); *H01H 85/36* (2013.01); *H01C 1/02* (2013.01); *H01C 1/14* (2013.01); *H01H 85/06* (2013.01); *H01H 85/175* (2013.01); *H01H 2085/0486* (2013.01); *H01H 2235/01* (2013.01)

(56) References Cited

U.S. PATENT DOCUMENTS

| | | | | |
|---|---|---|---|---|
| 7,741,946 | B2 | 6/2010 | Ho | |
| RE42,319 | E * | 5/2011 | Martenson | H01C 7/126 218/117 |
| 8,013,712 | B2 * | 9/2011 | Cernička | H01C 7/126 337/142 |
| 8,378,778 | B2 * | 2/2013 | Duval | H01C 7/126 338/13 |
| 8,836,464 | B2 * | 9/2014 | Wang | H01C 7/126 337/401 |
| 8,861,157 | B2 | 10/2014 | Ernhardt et al. | |
| 2001/0055187 | A1 | 12/2001 | McLoughlin et al. | |
| 2006/0145807 | A1 * | 7/2006 | Gautier | H01H 9/32 337/36 |
| 2009/0027153 | A1 | 1/2009 | Ho | |
| 2012/0105191 | A1 * | 5/2012 | Wang | H01C 7/126 337/414 |
| 2014/0232512 | A1 | 8/2014 | Yang et al. | |
| 2015/0280420 | A1 * | 10/2015 | Mao | H02H 9/043 361/91.2 |

FOREIGN PATENT DOCUMENTS

| | | | |
|---|---|---|---|
| DE | 102006052955 | A1 | 3/2008 |
| DE | 102009004703 | A1 | 4/2010 |
| DE | 102011053414 | A1 | 3/2013 |
| DE | 102013202795 | B3 | 3/2014 |
| EP | 1077452 | A2 | 2/2001 |
| EP | 2511915 | A1 | 10/2012 |
| EP | 2725588 | A1 | 4/2014 |
| EP | 2707892 | A1 | 6/2016 |
| KR | 200462103 | Y1 | 8/2012 |
| WO | 2005112050 | A1 | 11/2005 |
| WO | 2011102811 | A2 | 8/2011 |

* cited by examiner

VARISTOR COMPONENT AND METHOD FOR SECURING A VARISTOR COMPONENT

This patent application is a national phase filing under section 371 of PCT/EP2017/051393, filed Jan. 24, 2017, which claims the priority of German patent application 10 2016 102 968.8, filed Feb. 19, 2016, each of which is incorporated herein by reference in its entirety.

TECHNICAL FIELD

The present invention refers to varistor components with increased failure safety and to methods for securing varistor components under abnormal operation conditions.

BACKGROUND

Varistor components are electrical components having an electrical resistance that depends on the voltage applied to the component. It is possible that the resistance decreases with increasing applied voltage. A varistor component can have a resistance in the kΩ, MΩ or GΩ range when a voltage of a normal operation condition is applied to the component. If the applied voltage exceeds a critical voltage, then the component's resistance may be reduced to the range of a few ohm.

Such varistor components can be utilized as compensation elements in circuits or to protect sensitive circuits against excessive voltages. When used as a protection device, the varistor component can be electrically connected between a circuit and a ground potential and shunt potentially damaging electric power.

As a result, the electric power dissipating in varistor components may exceed critical values when the varistor component becomes low ohmic at high voltages and the dissipated power can destroy the varistor component or even destroy the whole electrical circuit, including the whole electrical device having the varistor component. When critical voltage conditions are exceeded, a varistor component may even catch fire.

From U.S. Patent Application Publication No. 2001/0055187 A1, severally protected metal oxide varistor components are known. A varistor component comprises a fuse and an insulating gap can be created when normal operation conditions are left.

From U.S. Patent Application Publication No. 2009/0027153 A1, further metal oxide varistor components are known. Again, a fuse is utilized to open the circuit to prevent further damage when normal operation conditions are left.

However, known varistor components with a meltable material establishing a fuse cannot guarantee that the fuse's material maintains an electrical connection after melting. Especially in environmental conditions where the orientation of varistor components or where the components are subject to accelerations, the place where the material of the fuse will flow to is unknown and the risk of maintaining an electrical connection exists.

SUMMARY OF THE INVENTION

Embodiments provide a varistor component with improved safety. In particular, embodiments provide a varistor component that improves the probability of obtaining an open circuit under abnormal operation conditions and reduces the probability of material of a fuse to maintain an electrical contact.

Further, embodiments provide a method of securing a varistor component in the case normal operation conditions are exceeded.

In various embodiments the varistor component comprises a first external contact and a second external contact. Further, the varistor component comprises a varistor electrically connected to the first external contact. The component further has a path between the varistor and the second external contact. Further, the varistor component has an active releasing device with a shutter and heat-sensitive element. The heat-sensitive element releases the shutter under abnormal operation conditions and the shutter closes the path between the varistor and the second external contact.

The varistor can be any kind of varistor, e.g., a metal oxide varistor.

In various further embodiments the first and the second external contact are provided to electrically connect the varistor component to an external circuit environment, e.g., as a shunting element between a ground potential and a sensitive electrical circuit to protect the sensitive electrical circuit from high voltage pulses.

In yet other embodiments the path between the varistor and the second external contact is the path where current should flow under normal operation conditions, i.e., between the first external contact and the second external contact while the respective voltage is applied to the varistor. The varistor and the path between the varistor and the second external contact are electrically connected in series.

The active releasing device distinguishes the varistor component from the above-cited varistor component as a shutter and a heat sensitive element are provided and as the releasing device is an active device. There is no need to rely on the melted material of the fuse to condense at a non-harmful position. The releasing device actively closes the shutter and preferably prevents a galvanic connected between the varistor and the second external contact.

For each varistor component, normal operation conditions, e.g., according to the known specifications to be fulfilled, are defined. The heat sensitive element is structured in such a way and its material, especially the material's melting temperature, is chosen in such a way that if the defined normal operation conditions are exceeded, the shutter closes the path between the varistor and the second external contact and—preferably independent from the later resting position of the condensed material—the closed path prevents further current and galvanically separates the varistor from the second external contact.

The critical values between normal operation conditions and abnormal operation conditions leading to the activation of the releasing device can refer to UL1449, section 39.4, Limited current abnormal overvoltage test, valid on Jan. 1, 2015.

It is possible that the heat-sensitive element is arranged in the path and establishes an electrical connection between the varistor and the second external contact.

Then, by closing the path and electrically separating the varistor from the second external contact, the varistor is electrically decoupled from an external circuit environment and no further electrical power can be dissipated and the potential danger of the varistor component catching fire is strongly reduced.

However, during normal operation conditions, the heat-sensitive element acts as an electrical link between the varistor and the second external contact and couples the varistor to an external circuit environment that may be connected to the second external contact so that the varistor of the varistor component can act as a protection element to protect the corresponding external circuit environment.

It is possible that the heat-sensitive element is solid below a chosen temperature and melts, i.e., liquefies, above the critical temperature. The heat leading to the phase transition of the heat-sensitive element can be produced by energy dissipation within the heat-sensitive element having a finite ohmic resistance itself. However, it is also or additionally possible that the heat-sensitive element reacts due to heat produced in the varistor being arranged in the physical vicinity of the heat-sensitive element. Further, it is also possible that the varistor component contains an additional heat dissipating element such as an ohmic resistor to produce heat that melts the heat-sensitive element when abnormal operation conditions are reached.

Thus, it is possible that the heat-sensitive element is a fuse and has a conducting material with a melting point below 230° C.

In particular, it is possible that the heat-sensitive element comprises a solder material with a corresponding melting temperature. The preferred melting temperature can be in between 185° C. and 205° C. A preferred corresponding material composition is a SnBi alloy solder paste such as SnBiAg or SnBiAgIn or another SnBi alloy.

It is possible that the varistor component further comprises a spring. The spring exerts a force onto the shutter.

Under normal operation conditions, the spring is arranged within the varistor component under tension. The heat-sensitive element is solid under normal operation conditions and blocks the shutter. Thus, the spring pushes to close the shutter but the solid heat-sensitive element keeps the shutter open and establishes an electrical connection between the varistor and the second external contact through the path.

When the temperature in the vicinity of the heat-sensitive element reaches a previously specified threshold, then the heat-sensitive element undergoes a transition into a liquid phase and cannot further withstand the spring's force. Correspondingly, in the instant the heat-sensitive element melts, the shutter is moved into a closing position by the spring and the galvanic isolation between the varistor and the second external contact is obtained.

In contrast to conventional varistor components where gravitational energy is utilized to displace the fuse's material which may not be displaced at all if the molten material cannot flow away, the functionality of the varistor component's releasing device is practically any time and in any position guaranteed and the response time of the releasing device is drastically reduced.

It is possible that the varistor component has a housing with a first hole. The shutter has a second hole arranged adjacent to the first hole during normal operation conditions. The first hole and the second hole establish a segment of the path between the varistor and the second external contact. The heat-sensitive element is a metallic body, e.g., a bold or a cylinder-shaped body, extending through the first and the second hole. Further, the heat-sensitive element electrically connects the varistor to the second external contact.

The heat-sensitive element can be in direct contact with the inner surface of the hole of the housing, the inner surface of the hole in the shutter and a conductor segment electrically connected to the second external contact. The heat-sensitive element blocks the shutter which is driven by the spring. When the critical temperature is reached, then the heat-sensitive element melts and cannot withstand the spring's force and the shutter is moved in such a way that the hole within the shutter is moved, i.e., translated or rotated, with respect to the hole in the housing in such a way that dielectric material of the shutter fully closes the whole in the housing.

It is possible that the shutter has a hub. The housing has a pivot arranged in the hub. Under abnormal operation conditions, the shutter revolves around the pivot and closes the path.

It is possible that the shutter is revolved at a fixed angle to cut off the fuse and to block and to prevent any kind of electrical connection between the varistor and the second external contact once the releasing device has been activated. A revolving shutter revolving around its hub surrounding the pivot of the housing has the advantage that no complex guide rail for the shutter is needed. As no complex guide rail is needed and as the shutter rotates around a single axis, the risk of jamming the shutter within the guide rail is reduced.

It is possible that the housing has a first pin, the shutter has a first pin and that the spring exerts a torque onto the first pins of the shutter and of the housing.

Thus, the pins of the housing and of the shutter are the elements rigidly connected to the housing and to the shutter in such a way that the force, e.g., torque, can act and the corresponding sections of the spring are supported.

The spring can be a coil spring or a spiral spring.

It is possible that the varistor component further comprises a third external connection. Under normal operation conditions, the third external connection is electrically separated from the first external contact and from the second external contact. If the zone of normal operation conditions is left and the releasing device is activated, then it is possible that the shutter removes the material of the heat-sensitive element from the path in such a way that the still conducting material of the heat-sensitive element establishes an electrical connection between the second external contact and the third external contact while the first external contact and the varistor are electrically separated from the second external contact and from the third external contact. By providing an electrical connection between the second external contact and the third external contact, an indicator of the circuit environment, e.g., an LED, can be switched on indicating the activation of the releasing device and indicating an error in the external circuit environment leading to the activation of the releasing device.

It is possible that the first external contact, the second external contact and the third external contact are lead wired extending from a housing of the varistor component.

It is possible that the shutter comprises a material consisting of a thermoplastic or a ceramic.

It is preferred that the shutter comprises a dielectric material with a low conductivity and with a high resistance towards high temperatures.

It is possible that the varistor component further comprises a cap. The shutter and the heat-sensitive element are arranged in a cavity and the cap covers the cavity.

Then, the internal mechanics of the varistor component enabling the varistor component to activate the shutter fast and with an improved failure safety is protected from environmental influences. Further, the molten and hot material of the heat-sensitive element cannot leave the cavity and harm the varistor component's environment.

It is possible that the shutter is designated to close the path under abnormal operation conditions independent from the orientation of the varistor component and independent from accelerations applied to the component.

The materials for the housing, the cap the shutter can be a dielectric material with a resistance against temperatures higher than 230° C. In particular, the housing and the shutter can comprise or consist of ALCP (Aromatic Liquid Crystal Polymer). The spring can comprise or consist of a steel. The External contacts can comprise or consist of Cu (copper) or Ag (silver). The varistor can be a zinc oxide disc shaped varistor sintered at approx. 1100° C.

The housing can have a cylindrical shape with a diameter of 15 mm, 19 mm, 20 mm, 26 mm or bigger than 26 mm. The thickness of the housing can be approx. 7 mm. The shutter can have the shape of a cross section of a bell and have a thickness of approx. 0.8 mm.

The voltage threshold between normal operation and abnormal operation depends on the heat generation and thus on materials and dimensions of the components.

The second external contact can have a rod shaped body and a bolt shaped head. The rod shaped body is provided for a connection to an external circuit environment. The bold shaped head is provided for a connection to the heat sensitive element. The bold shaped head can have a thickness larger or slightly larger than the thickness of the body.

A method of securing a varistor component as described above has the shutter actively closed the path and electrically separated the varistor from the second external contact.

BRIEF DESCRIPTION OF THE DRAWINGS

The varistor component, the working principles of the component and details of preferred embodiments are shown in the accompanied schematic figures.

DETAILED DESCRIPTION OF ILLUSTRATIVE EMBODIMENTS

Figure 1:
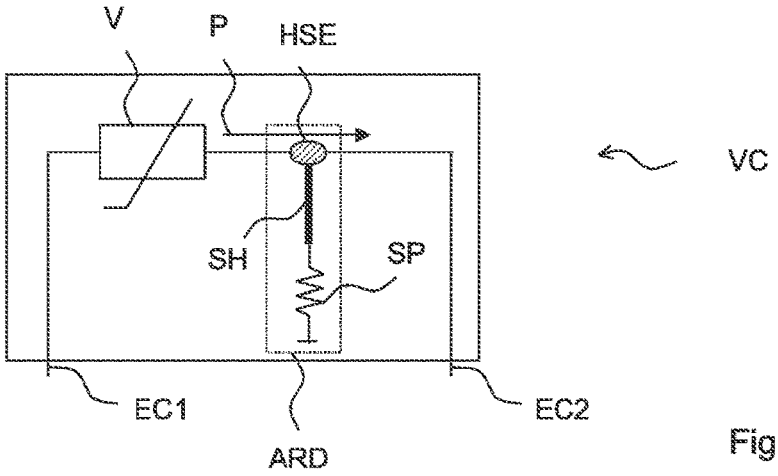
FIG. 1 shows the working principle of the varistor component.

FIG. 1 shows the basic working principle of the varistor component VC. The varistor component VC has a varistor V, a first external contact EC1 and a second external contact EC2. The varistor V is electrically connected in series between the first external contact EC1 and the second external contact EC2 under normal operation conditions. The heat-sensitive element HSE is electrically connected between varistor V and the second external contact EC2 and arranged in the path P indicated by the arrow. The varistor component VC further comprises a shutter SH as part of the active releasing device ARD.

Under normal operation conditions, the heat-sensitive element HSE is solid and electrically connects the varistor V to the second external contact EC2. However, when the temperature of the heat-sensitive element HSE exceeds a previously chosen limit, then the heat-sensitive element HSE melts and the shutter SH actively closes the path P and electrically separates the varistor V from the second external contact EC2. The shutter SH can be driven by a spring SP.

The fact that the shutter SH is actively driven reduces the response time of the shutdown of the varistor component and increases the reliability of the varistor component.

Figure 2:
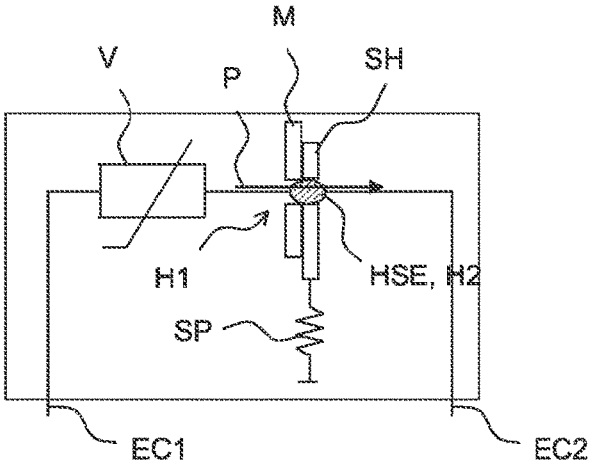
FIGS. 2 and 3 show an embodiment where a hole of the shutter is moved relative to a hole of a mask when the releasing device is activated.
Figure 3:
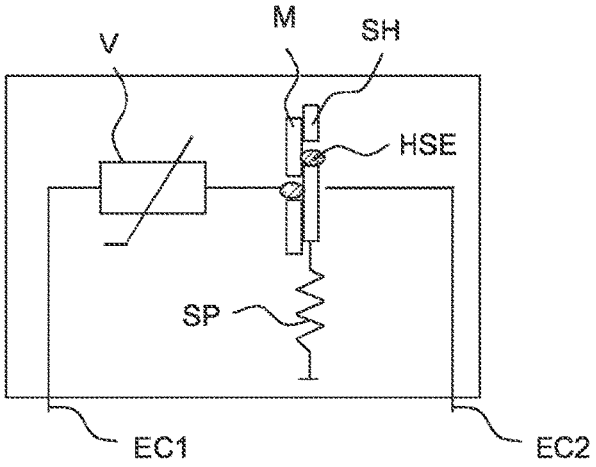

FIGS. 2 and 3 illustrate the working principle of an embodiment where the varistor component has a first hole H1 in a mask M and a second hole H2 in the shutter SH. The heat-sensitive element HSE is arranged in the two holes establishing the current path P. When the releasing device is activated (FIG. 3), the heat-sensitive element HSE melts and cannot further withstand the spring's SP force. Thus, the shutter is moved and the hole H2 of the shutter is moved relative to the hole H1 in the mask M and the path is blocked leading to the electrical separation of the varistor V from the second external contact EC2.

It is preferred that the shutter SH, e.g., a segment without a hole, fully closes the hole in the mask M in such a way that residual material of the melted heat-sensitive element HSE cannot establish a remaining electrical connection between the varistor V and the second external contact EC2.

Figure 4:
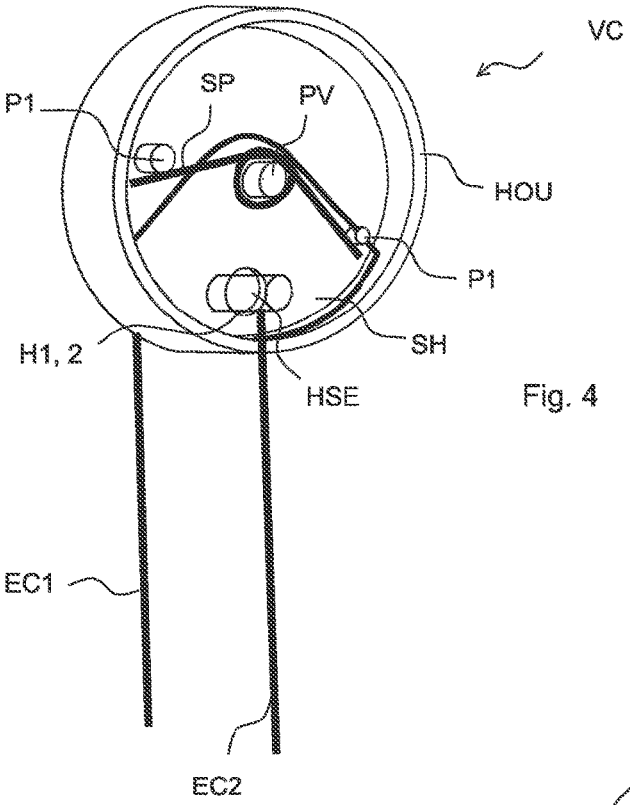
FIG. 4 shows a perspective view of an embodiment with a cylinder-shaped housing.

FIG. 4 shows an embodiment where the mask and the shutter have such a geometrical shape that the probability that remaining material of the heat-sensitive element HSE maintains an electrical connection. The varistor component VC has a housing HOU in which the elements of the mechanism of the active releasing device ARD are arranged. The housing HOU has mainly the shape of a cylinder. The backside of the housing HOU establishes the mask M as illustrated in FIG. 3. The shutter has a bell-shaped footprint and a first pin P1. The housing HOU also has a first pin P1 and the first pins P1 of the housing HOU and of the shutter SH support the spring SP, which may be a coil spring or a spiral spring. Further, the housing HOU has a pivot PV establishing an axis around which the shutter SH can revolve. The heat-sensitive element HSE has mainly the shape of a cylinder and is in mechanical contact with the inner walls of the holes of the housing H1 and the shutter SH and is in contact to a wire electrically connected to the second external contact EC2. While the heat-sensitive element HSE is solid, the element holds the shutter SH in the open position with the shutter's hole H2 being arranged directly over the hole H1 of the housing HOU. The heat-sensitive element HSE establishes the electrical contact between the varistor (not shown in FIG. 4 but being arranged directly behind the housing HOU) and the second external contact EC2.

When the temperature of the heat-sensitive element HSE exceeds a critical temperature and the heat-sensitive element melts, then the spring SP revolves the shutter SH by exerting a force onto pin P1 of the shutter SH revolving the shutter SH in a counter-clockwise direction.

The external contact EC2 can have a rod shaped body and a bolt shaped head thicker than the rod shaped body. The bolt shaped head can have a rectangular cross section to be connected to the heat sensitive element HSE.

Figure 5:
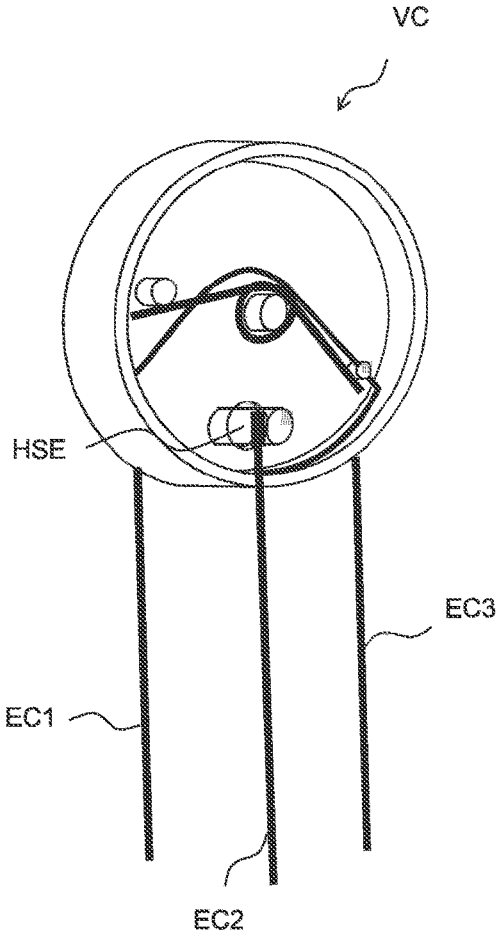
FIG. 5 shows a perspective view of a varistor component with a third external contact.

FIG. 5 shows an embodiment where the varistor component VC has a third external contact EC3 that is electrically connected to a metallization within the cavity in the housing HOU. Under normal operation conditions, the third electrical contact EC3 is electrically separated from the first and from the second external contacts EC1, EC2. However, once the heat-sensitive element HSE is molten, the residual material can electrically connect the third external contact EC3 to the second external contact EC2 to indicate the activation of the active release device ARD to an external circuit environment.

Figure 6:
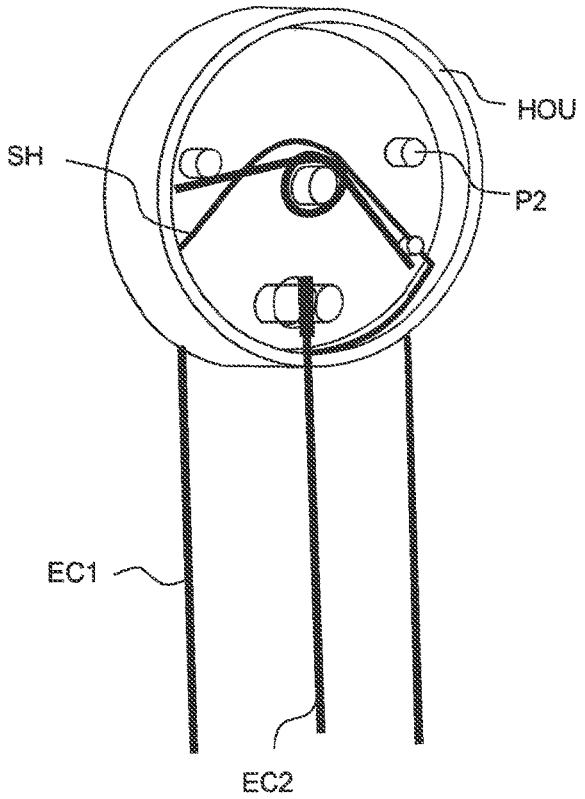
FIG. 6 shows an embodiment where the housing has a second pin establishing a stop for the shutter to confine the shutter's movement.

FIG. 6 shows a further embodiment where the housing HOU has a second pin P2 which defines a stop position for the shutter SH.

Figure 7:
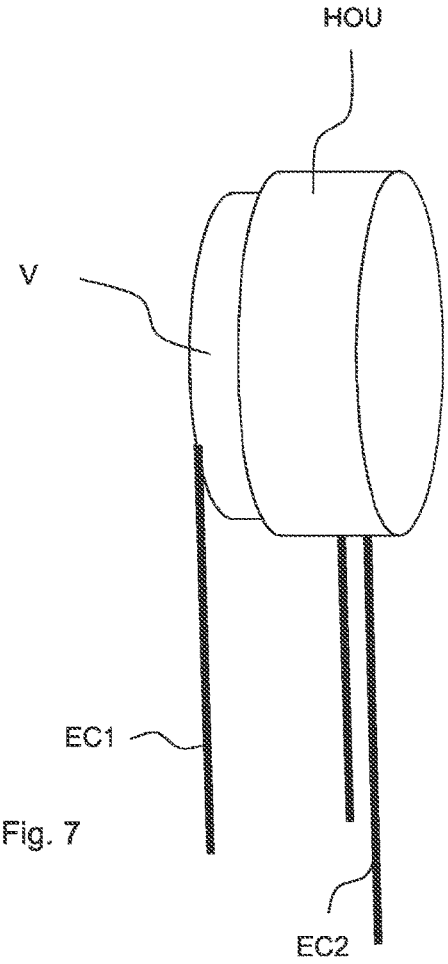
FIG. 7 shows a perspective view of an embodiment indicating the orientation of the varistor relative to the housing including the releasing device's mechanism.

FIG. 7 shows a perspective view of a varistor component indicating the position of the varistor V relative to the housing HOU including the elements of the mechanism of the active release device ARD. The varistor V is arranged behind the housing HOU. The varistor V also can have a cylinder shape and one side of the cylinder points at the varistor component's housing HOU is such a way that it can be electrically connected to the second external contact via the current path P.

The first external contact EC1 electrically connects the respective backside of the varistor V that points away from the housing HOU.

Figure 8:
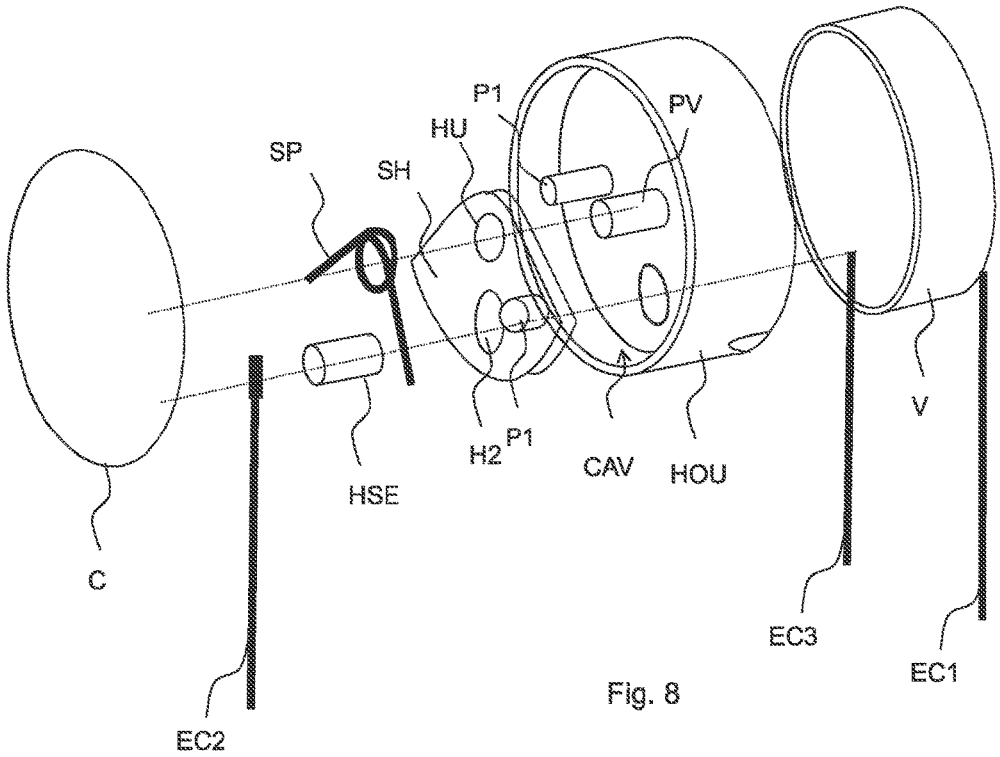
FIG. 8 shows an exploded view of the varistor component, especially of the releasing device.

FIG. 8 shows an exploded view of the main components of the mechanism of the active release device ARD to emphasize the construction and the working principle of the corresponding embodiment.

The housing HOU has a cavity CAV in which a first pin P1 of the housing HOU and a pivot PV of the housing HOU extend from a backside of the housing HOU. The bell-shaped shutter SH has a hole that acts as a hub HU and a hole H2 establishing a segment of the path during normal mode. Further, the shutter SH has its first pin P1 to support the spring SP. During normal operation, the hub HU surrounds the pivot PV of the housing HOU and the shutter SH can rotate around the corresponding axis through the pivot PV. The spring SP uses the first pin P1 of the housing HOU to exert a torque onto the shutter SH via the shutter's pin P1. The heat-sensitive element HSE is arranged in the hole of the housing HOU and the hole H2 in the shutter SH. Further, the heat-sensitive element HSE electrically connects the side of the varistor V pointing towards the housing HOU to the hook-shaped conductor segment of the second external contact EC2. The cavity CAV is covered by cap C to protect the mechanism against environmental influences and to protect the environment against molten material of the heat-sensitive element SHE.

Figure 9:
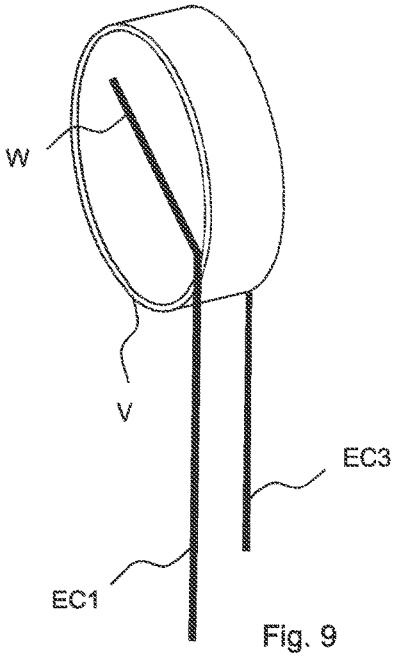
FIG. 9 shows a perspective view of the back of the varistor and its electrical connection to the first external contact.

FIG. 9 shows the backside of the varistor V with a wire W attached to its backside establishing the connection between the varistor V and the conductor of the external connection EC1.

Figure 10:
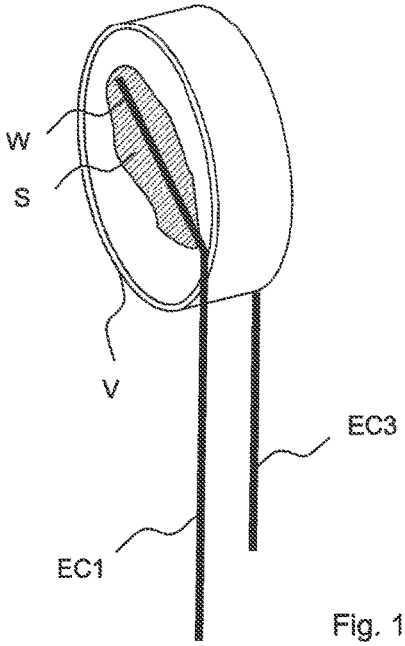
FIG. 10 shows an embodiment where the first external contact is soldered to the back of the varistor.

FIG. 10 shows a preferred embodiment of the backside of the varistor V where the wire W is mechanically and electrically connected to the backside of the varistor V using a solder material S.

Figure 11:
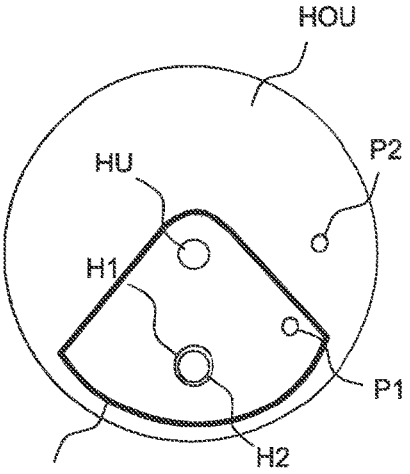
FIGS. 11 and 12 illustrate the working principle of a revolving type shutter.
Figure 12:
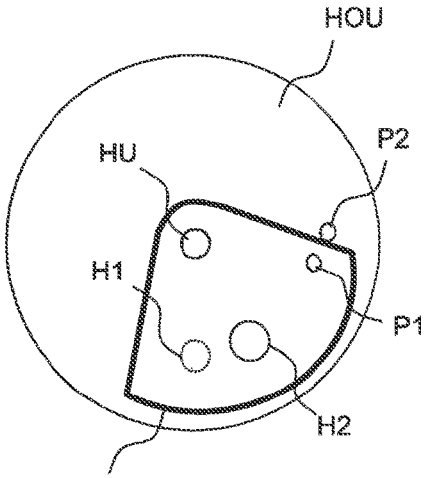

FIGS. 11 and 12 illustrate the working principle of the shutter SH being in the position of normal operation in FIG. 11 and being in the activated position in FIG. 12. In the position of the normal operation, the hole H1 of the housing HOU and the hole H2 of the shutter SH are directly arranged one above the other and the path between the varistor and the second external contact is open.

After activating the active release device ARD, the shutter SH is revolved around the hub HU in a counter-clockwise direction until the shutter SH hits the second pin P2 defining a stop position. The hole H2 of the shutter SH is moved relative to the hole H1 of the housing HOU leaving the path blocked by the shutter SH.

Figure 13:
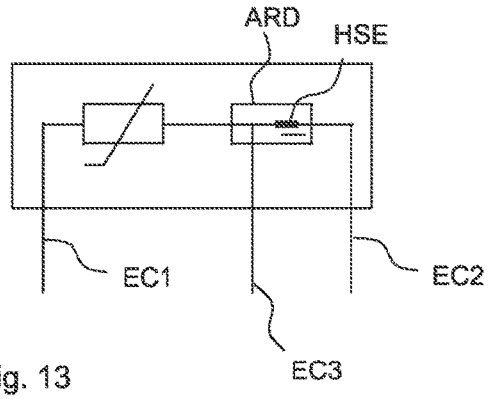
FIGS. 13 and 14 indicate the working principles of the third external contact.
Figure 14:
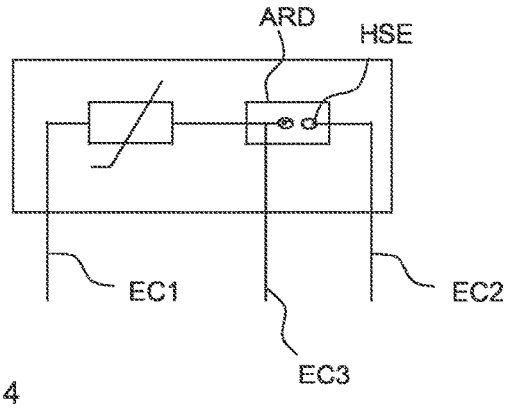

FIGS. 13 and 14 illustrate the basic principle of the third external contact EC3. The third external contact EC3 is electrically separated from the other two external contacts EC1, EC2 during normal operation as the heat-sensitive element HSE is in its position to connect the varistor to the second external contact EC2. FIG. 14 illustrates the situation after activation. The material of the heat-sensitive element HSE is removed from its original position. The electric path between the varistor and the external contact EC2 is blocked (open circuit) and material of the heat-sensitive element HSE electrically connects the second external contact EC2 to the third external contact EC3.

The varistor component can have additional elements such as additional shutters, fuses, springs, electrical connections, and the housing can have a polygon shape, e.g., a rectangular shape basic area. The shutter can be a rotating shutter or a shutter with a linear movement.

The invention claimed is:

1. A varistor component comprising:

a first external contact;

a second external contact;

a third external contact;

a varistor electrically connected to the first external contact;

a path between the varistor and the second external contact; and an active releasing device comprising a shutter and a heat sensitive element, wherein the heat sensitive element releases the shutter under abnormal operation conditions and the shutter closes the path between the varistor and the second external contact, and wherein, under abnormal operation conditions, the heat sensitive element electrically connects the second external contact to the third external contact.

2. The varistor component of claim 1, wherein the heat sensitive element is arranged in the path and establishes an electrical connection between the varistor and the second external contact.

3. The varistor component of claim 1, wherein the heat sensitive element is a fuse and has a conducting material with a melting point below 230° C.

4. The varistor component of claim 1, further comprising a spring exerting a force onto the shutter.

5. The varistor component of claim 1, further comprising a housing with a first hole, where the shutter has a second hole arranged adjacent to the first hole, wherein the first and the second holes establish a segment of the path, and wherein the heat sensitive element is a metallic body extending through the first and the second holes and electrically connecting the varistor to the second external contact.

6. The varistor component of claim 5, wherein the shutter has a hub, wherein the housing has a pivot arranged in the hub, and wherein, under abnormal operation conditions, the shutter revolves around the pivot closing the path.

7. The varistor component of claim 5, wherein the housing has a first pin, wherein the shutter has a first pin, and wherein a spring exerts a torque onto the first pins of the shutter and of the housing.

8. The varistor component of claim 1, wherein the first and second external contacts and the third external contact are lead wires.

9. The varistor component of claim 1, wherein the shutter comprises a material consisting essentially of a thermoplastic or a ceramic.

10. The varistor component of claim 1, further comprising a cap, wherein the shutter and the heat sensitive element are arranged in a cavity and the cap covers the cavity.

11. The varistor component of claim 1, wherein the shutter is designated to close the path under abnormal operation conditions independent from an orientation of the varistor component.

12. A method of securing a varistor component according to claim 1 under abnormal operation conditions, the method comprising:

actively closing the path and electrically separating the varistor from the second external contact by the shutter.

13. A varistor component comprising:

a first external contact;

a second external contact;

a third external contact;

a varistor electrically connected to the first external contact;

a path between the varistor and the second external contact; and an active releasing device having a shutter and a heat sensitive element, wherein the heat sensitive element releases the shutter under abnormal operation conditions and the shutter closes the path between the varistor and the second external contact, wherein, under abnormal operation conditions, the heat sensitive element electrically connects the second external contact to the third external contact, and wherein the first, second and third external contacts are lead wires.

14. A varistor component comprising:

a first external contact;

a second external contact;

a third external contact;

a varistor electrically connected to the first external contact;

a path between the varistor and the second external contact; and an active releasing device having a shutter and a heat sensitive element, wherein the heat sensitive element releases the shutter under abnormal operation conditions and the shutter closes the path between the varistor and the second external contact, wherein, under abnormal operation conditions, the heat sensitive element electrically connects the second external contact to the third external contact, and wherein the shutter comprises a material consisting essentially of a thermoplastic or a ceramic.

* * * * *